US005983537A

United States Patent [19]

Johnson

[11] Patent Number: 5,983,537

[45] Date of Patent: Nov. 16, 1999

[54] MAGNETICALLY SUPPORTABLE CARD DEVICE AND METHOD OF PRODUCING SAME

[76] Inventor: Keith D. Johnson, 10217 1st Ave., Inglewood, Calif. 90303

[21] Appl. No.: 08/946,560

[22] Filed: Oct. 8, 1997

[51] Int. Cl.[6] ..... G09F 01/10

[52] U.S. Cl. ..... 40/124.04; 40/600

[58] Field of Search ..... 40/124.04, 124.191, 40/600, 666.01, 711

[56] References Cited

U.S. PATENT DOCUMENTS

| | | | |
|---|---|---|---|
| 2,677,910 | 5/1954 | Morgan | 40/711 |
| 3,698,111 | 10/1972 | Smith | 40/661.01 |
| 4,236,331 | 12/1980 | Mattson | 40/600 X |
| 4,310,978 | 1/1982 | Stern | 40/661.01 X |
| 5,274,937 | 1/1994 | Birnbaum | 40/600 |
| 5,303,489 | 4/1994 | Blegen | 40/711 |
| 5,375,351 | 12/1994 | King et al. | 40/124.04 |
| 5,458,282 | 10/1995 | Martin | 229/92.8 |
| 5,621,993 | 4/1997 | Stover | 40/600 X |

*Primary Examiner*—Joanne Silbermann
*Attorney, Agent, or Firm*—Robert J. Schaap

[57] ABSTRACT

A novel card device which may be supported on a refrigerator or other metallic objects by magnetic coupling thereto. The card device is preferably made in the form of a mailable postcard or otherwise a greeting card or an announcement card. In the case of an announcement card and postcard, a single substrate is employed and a magnetic film is adhesively secured to an upper face of the substrate. A second substrate or otherwise a portion of the first substrate may be folded over and placed facewise upon the second substrate and adhesively secured thereto. The magnetic film is thereby captured between the two plies. In the preparation of a greeting card, a substrate may be folded into three different panels with one panel being folded over the next adjacent panel and attached thereto with a magnetic film secured therebetween, again usually by adhesives. A message may be then presented on any of the exposed faces of the panels. In addition, individual strips of the magnetic film may be employed.

16 Claims, 2 Drawing Sheets

MAGNETICALLY SUPPORTABLE CARD DEVICE AND METHOD OF PRODUCING SAME

BACKGROUND OF THE INVENTION

1. Field of the Invention

This invention relates in general to certain new and useful improvements in cards which are capable of being magnetically coupled to a metallic substrate and, more particularly, to cards which may be prepared in the form of a postcard, a greeting card, or other information bearing card, and which is light in weight and highly effective in use.

2. Brief Description of the Related Art

In recent years, flexible and bendable magnetic films have been commercially available. These films usually include a substrate, such as a cellulose substrate, e.g., a paper substrate, with magnetic material either coated on the substrate or otherwise applied thereto. The substrate with the metallic and magnetically prepared material thereon will then function as a permanent magnetic. One such form flexible magnetic is offered by Magnetic Specialty, Inc. of Murrietta, Ohio.

With the advent of these flexible magnetics, there have been several attempts to produce a card, in the nature of commercially usable cards employing this flexible magnet. There has been one very recent attempt to produce a postcard employing this flexible magnet. The postcard uses two overlying plies with the magnet embedded therebetween. However, the plies are relatively thick so as to be capable of supporting the magnetic film captured therebetween and this interferes with the magnetic coupling to a supporting surface such as a refrigerator. Consequently, only very weak magnetic coupling is obtained. In addition to the foregoing, the device uses a rather large block of the magnetic film thereby substantially increasing the weight of the card. As a result, the card cannot be used as a postcard at standard postcard mail rates, and when so used, a much higher amount of postage is required.

For many years, people have attached notes, paper announcements and the like to refrigerators as a type of reminder. The same holds true with calendars and the like. Normally, these cards, calendars and other substrates are secured to the refrigerator by permanent magnets which are used for this purpose. In fact, many novelty stores offer magnets for attachment of substrates to a refrigerator. It would be desirable to provide a postcard which could be readily and easily secured to a refrigerator without the need of an external magnet for attaching same. This postcard could contain information, as for example, a health professional appointment or the like. However, it is imperative that any such postcard be capable of being mailed at low postcard mail rates in any country of use. Otherwise, the much higher cost of mailing may render the use of the postcard to be prohibitive.

It would also be desirable to use these flexible magnets in other forms of cards, as hereinafter described, so that the cards could also be mounted on a metallic wall. However, light weight is a paramount requirement and, moreover, low cost is also equally critical. There has been a need for a card of this type for some period of time, although none have been available or proposed.

OBJECTS OF THE INVENTION

It is, therefore, one of the primary objects of the present invention to provide a magnetically couplable card which is capable of being secured to a metallic wall and which is light in weight and provides good magnetic coupling.

It is another object of the present invention to provide a card of the type stated which may be prepared in the nature of a postal card and which can be mailed at postal card rates due to the light weight thereof, but which still sufficiently provides magnetic flux capable of enabling good magnetic coupling to a metallic wall.

It is the further object of the present invention to provide a magnetic card of the type stated which may be in the nature of a greeting card, such that it may be mounted on a metallic wall and saved.

It is an additional object of the present invention to provide a magnetically couplable card of the type stated which may be in the nature of an announcement card capable of being removably mounted on a metallic wall for reminders of an appointment.

It is another salient object of the present invention to provide a method of making a magnetic card which is light in weight and yet which provides substantial magnetic coupling to a metallic wall.

It is yet another salient object of the present invention to provide a method of the type stated which enables the production of a relatively low cost card and which can be prepared with a minimal amount of manual intervention.

With the above and other objects in view, my invention resides in the novel features of form, construction, arrangement, and combination of parts and components presently described and pointed out in the claims.

SUMMARY OF THE INVENTION

The present invention relates to a magnetically couplable card which may be removably mounted on a metallic wall. The card may be available in several embodiments and, in each of these embodiments, the card is light in weight and yet provides substantial magnetic coupling ability.

In one embodiment of the invention, a card is provided in the nature of a postcard. In this case, a magnetic film, such as the so-called "flexible magnetic" is adhesively secured to an upper face of the substrate. Another portion of that substrate is then folded over the magnetic and the first substrate is disposed in marginal registration therewith and adhesively secured thereto. In like manner, it is possible to use two individual substrates although in the first preferred embodiment, a portion of the first substrate is merely folded over upon itself to enclose the magnetic film therebetween. The adhesive on the second substrate or otherwise the second half of the initial substrate may be pre-applied thereto with a releasable backing paper, or otherwise is can be applied at the time of use, by merely spraying the same onto the top cover sheet.

The same construction is employed in the preparation of an announcement card. Moreover, in order to avoid the weight associated with prior art cards, a very thin but highly effective magnetic stip is employed. Moreover, individual strips may be used. In this way, and particularly for larger cards, there is still sufficient magnetic coupling but without the attendant weight of a single large flexible magnet or magnetic film.

The present invention is capable of being made into a greeting card. In this case, a single substrate is folded into three individual panels. A flexible magnetic strip is then adhesively applied to the upper face of the center panel and one of the end panels folded thereover and secured thereto by an adhesive coating. The third end panel will remain hingedly connected to the middle panel so that the entire device adopts the form of a two panel greeting card. In this way, the greeting card can be stored after opening by the recipient and mounted on a refrigerator or like metallic surface for retention, and which thereby avoids some of the inherent disposal of greeting cards.

Several embodiments of the magnetically couplable card and the method of making same are hereinafter described in the following detailed description of this invention and are also illustrated in the accompanying drawings. However, it should be understood that this detailed description and the accompanying drawings are only set forth for purposes of illustrating general principles of the invention and are not to be taken in a limiting sense.

BRIEF DESCRIPTION OF THE DRAWINGS

Figure 1:
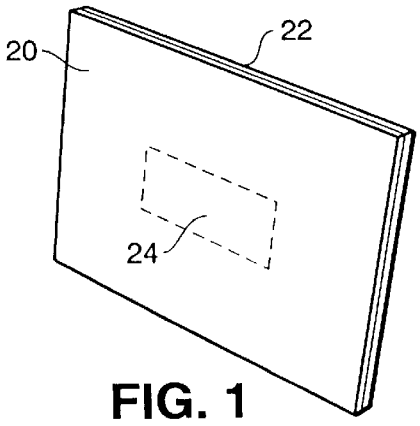
Figure 2:
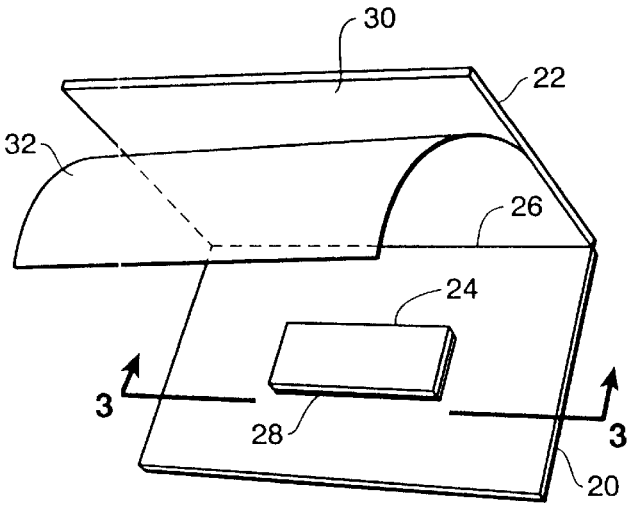
Figure 3:
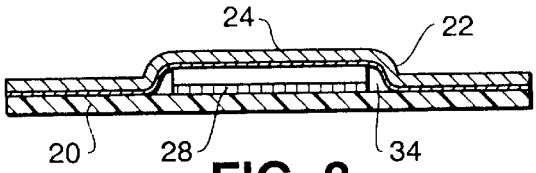
Figure 4:
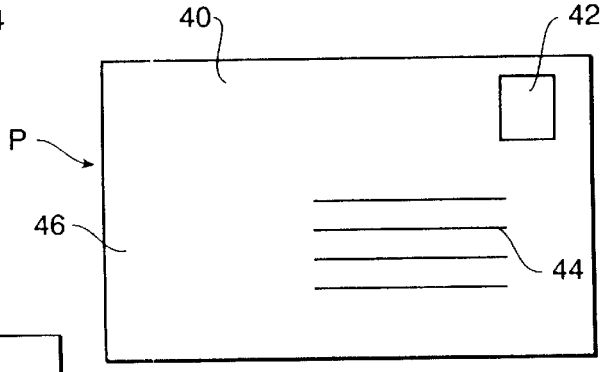
Figure 5:
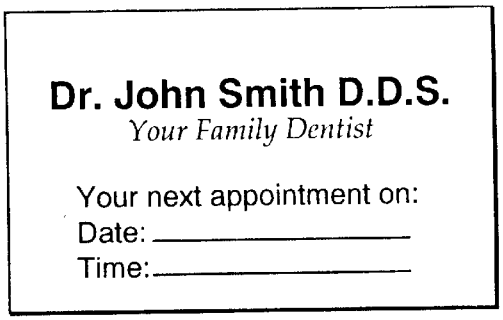
Figure 6:
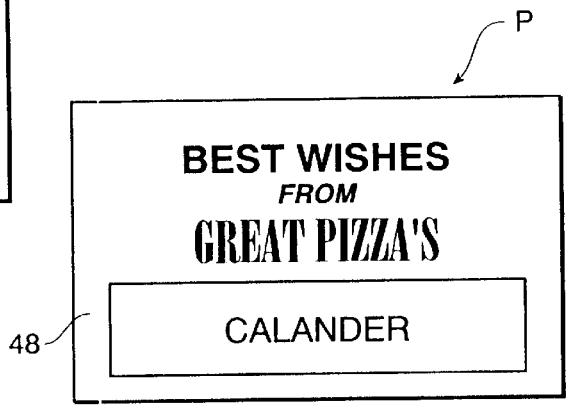
Figure 7:
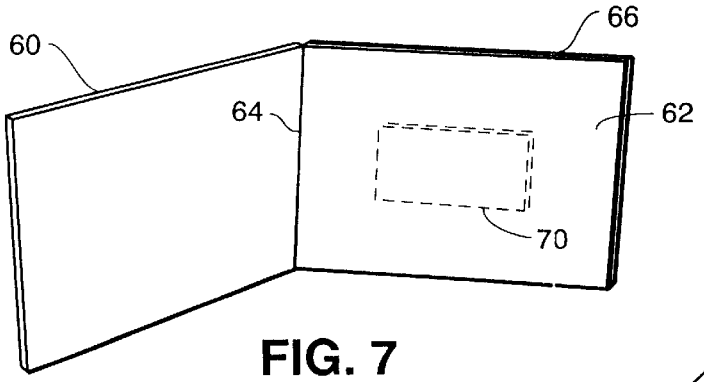
Figure 8:
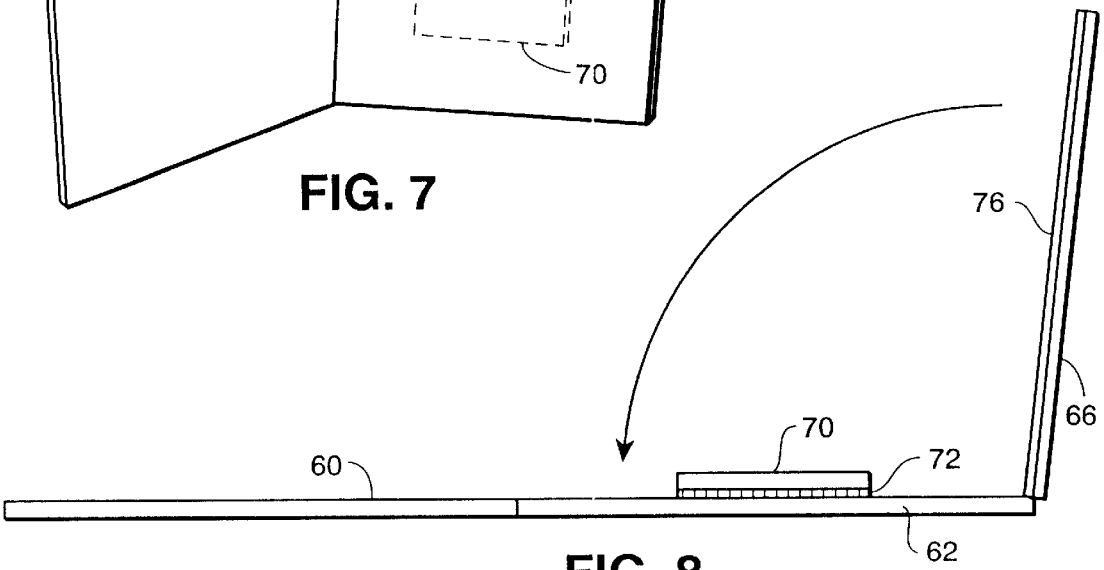
Figure 9:
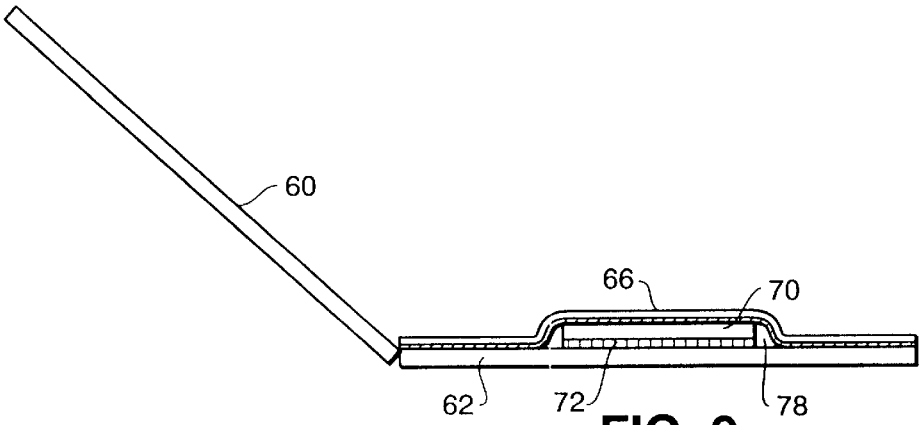
Figure 10:
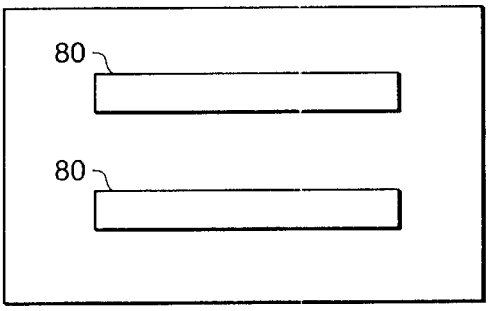

Having thus described the invention in general terms, reference will now be made to the accompanying drawings in which:

FIG. 1 is a perspective view of a magnetic card constructed in accordance with and embodying the present invention;

FIG. 2 is a perspective view of a magnetic card being prepared in accordance with the method of the present invention;

FIG. 3 is a sectional view taken substantially along line 3—3 of FIG. 2;

FIG. 4 is a plan view of one of the faces of the magnetic card showing the use of the card as a postcard;

FIG. 5 is a plan view of the opposite face of the card of FIG. 4;

FIG. 6 is a plan view of one face of a magnetic card in the form of an announcement card and which may contain a calendar thereon;

FIG. 7 is a perspective view of a magnetic card in the form of a greeting card;

FIG. 8 is a plan view showing the formation of a greeting card in accordance with the present invention;

FIG. 9 is a sectional view showing the details of construction of the greeting card of the present invention; and FIG. 10 is a plan view showing an alternate magnetic film arrangement for producing a greeting card in accordance with the present invention.

DETAILED DESCRIPTION OF A PREFERRED EMBODIMENT

Referring now in more detail and by reference characters to the drawings, which illustrates several practical embodiments of the present invention, C designates a card device. The card device C represents one of the generic forms of the invention and is a component of each of the card devices, as hereinafter described.

The card device C comprises a first substrate 20 and a second substrate 22 secured thereto and in marginal registration therewith. Captured between the first and second substrates 20 and 22 is a magnetic 24, as best shown in FIGS. 1–3 of the drawings.

In a preferred embodiment of the invention, the second substrate is integral with the first substrate and is capable of being folded over the first substrate. In this case, a single sheet of paper, for example, can folded in halves to thereby define the first and second substrates. The second substrate 22 is effectively secured to the first substrate 20 along a fold line 26. Otherwise, a score line or the like could be employed.

A magnetic film or magnet 24 is secured to an inner surface of the first substrate 20 and which is sometimes herein referred to as a "second surface" by means of an adhesive layer 28. The adhesive layer may be initially supplied on a surface of the magnet 24 or otherwise on the inner surface of the first substrate 20. Any suitable adhesive may be employed for this purpose.

The second substrate 22 also has a inwardly presented surface and frequently referred to as a "first surface" of the second substrate which faces the inner surface of the substrate 20. Formed on the inner surface of the substrate 22 is an adhesive layer 30 and which may be covered by a releasable backing 32. In accordance with the invention as shown in FIG. 2, it can be seen that the releasable backing 32, frequently referred to as a "release paper", can be peeled from the adhesive layer 30 and removed. The adhesive layer 30 then allows the second substrate 22 to be adhesively secured to the upper surface of the magnet 24 and to the inner surface of the first substrate 20, to thereby form a magnet containing card as shown in FIG. 3. When the first and second substrates are secured to one another, as so described, they form a very small pocket 34 in which the magnet 24 is retained. In this way, the magnet is not free to move within this pocket.

It should be understood that in place of providing a pre-coated adhesive on the second substrate 22, that an adhesive could be applied to the inner surface of that substrate shortly before securement to the first substrate. Generally, this adhesive coating can be applied by spraying the same onto that inner surface. Furthermore, an adhesive coating could also be provided on the inner surface of the first substrate in addition to or in place of the adhesive coating on the second substrate. Nevertheless, it has been found that producing the card in accordance with the manner as shown in FIG. 2 is preferred.

FIGS. 4 and 5 illustrate opposite sides of a postcard P comprising the card device C in accordance with the present invention. The postcard P includes on one surface 40 thereof pre-printed information enabling the card device to function as a postcard and which includes the postage 42 pre-recorded thereon. The first surface 40 also has addressee information lines 44 imprinted thereon and a space 46 in which to provide a message by the sender. The opposite side of the postcard presents a surface 48 which may be presented with any suitable information as, for example, date reminder information. In this case, it can be observed that a sender of the postcard would be advising a recipient of a dental appointment. Not only does this function as a reminder to the recipient, but it also constitutes a type of promotional activity by the dentist who is sending the same. This type of card is highly effective in that the recipient can merely stick the card onto his or her refrigerator or other metal wall board as a reminder.

It should also be understood that the postcard could adopt other forms of presenting information. For example, the information may adopt advertising or promotional information creating a promotional card, as shown in FIG. 6. Thus, the card can incorporate pictorial illustrations thereon or other information of utilitarian value, such as a calendar. In the specific embodiment as illustrated, the promotional card illustrates the name of the sender which would frequently remind the user of the sender and would also function effectively as a calendar.

FIG. 7–9 illustrate the magnetic card device of the present invention in the form of a greeting card. In this particular case, the first and second substrates are employed, although they are integral with one another and therefore referred to as first and second panels. Thus, the greeting card, FIGS. 7–9, includes a first panel 60 and a second panel 62, with the second 62 being an intermediate panel and integral with the first panel through a fold line 64. In the case of a greeting card, a third panel 66 is secured to an outer edge of the second panel 62 along a fold line 68. A magnetic film or magnet 70 is adhesively secured to the upper surface of the second panel or intermediate panel 62 by means of an adhesive layer 72, as best shown in FIGS. 8 and 9 of the drawings. Again, any suitable adhesive may be employed and, moreover, the magnet may be provided with the adhesive pre-coated thereon. The third panel 66 is also provided with an adhesive coating 74, which may also be pre-coated thereon and covered by a releasable backing such as a backing similar to the backing 32. However, when the adhesive coating is provided on the third panel 66, this panel can then be folded along the hinge line 68 so that is lies in marginal registration with the upper surface of the second ply 62, as best shown in FIG. 9 of the drawings. In this way, a pocket 78 is formed between the second and third plies to retentively hold the magnetic film 70 therein.

FIG. 10 illustrates an embodiment of the invention in which a plurality of magnets 80 can be employed in spaced apart relationship to one another. Although FIG. 10 only illustrates a pair of magnets in spaced apart relationship, it should be understood that three or more magnets could also be used. Moreover, the magnets can be spaced from one another in a parallel relationship, as shown, or they may be spaced apart from one another in a vertical relationship, or in any other arrangement relative to one another and relative to the panels.

Thus, there has been illustrated and described a unique and novel card device and method of making same which fulfills the aforementioned objects. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus described the invention, what I desire to claim and secure by Letters Patent is:

1. A card device for presenting information thereon and which is capable of being removably secured to a metal containing surface, said card device comprising:

a) a first substrate having a first surface and a second surface and a peripheral edge;

b) a magnet adhered to said second surface of said first substrate and having a peripheral edge with all portions thereof spaced inwardly from the peripheral edge of the first substrate so that a portion of the first surface surrounds the entire peripheral edge of the magnet;

c) an adhesive layer securing a surface of said magnet to said second surface of said first substrate;

d) a second substrate capable of being disposed over said first substrate and lying in marginal registration therewith thereby enclosing said magnet in a pocket between said first and second substrates;

e) another adhesive layer securing said second substrate to said first substrate, such that the first and second substrates surround the magnet and form a pocket therebetween to snugly hold and encapsulate the magnet therein; and f) a third substrate hingedly connected to one of said first or second substrates and capable of being disposed therefore.

2. The greeting card device of claim 1 further characterized in that said greeting card is a postcard and that said second substrate has an outwardly presented surface with information to create a mailable postcard.

3. The greeting card device of claim 1 further characterized in that said card device has indicia on the outer surface of said first substrate and indicia on the outer surface of the third substrate.

4. The greeting card device of claim 1 further characterized in that said second substrate is integral with said first substrate and bent over said first substrate.

5. The greeting card device of claim 1 further characterized in that a plurality of individual spaced apart magnets are secured to said first substrate and are enclosed in pockets formed by said first substrate and second substrate.

6. A greeting card device capable of being releasably secured to a metal containing wall by magnetic coupling, said greeting card device comprising:

a) a first panel having an inner surface and an outer surface thereof and a peripheral edge with indicia on said outer surface;

b) a second panel hingedly connected to said first panel and capable of being closed and opened with respect to said first panel in the nature of a book, said second panel having an inner surface and a peripheral edge;

c) a magnet secured to said inner surface of said second panel and spaced from said first panel, said magnet having a peripheral edge with all portions thereof spaced apart from the peripheral edge of the second panel so that a portion of the first panel surrounds the entire peripheral edge of the magnet; and d) a third panel secured to said second panel and forming a pocket for enclosing and encapsulating said magnet therein and with the first and second panels surrounding the magnet and forming a pocket therebetween to snugly hold and encapsulate the magnet therein.

7. The greeting card device of claim 6 further characterized in that said third panel is initially hingedly connected to said second panel and folded over said second panel in marginal registration therewith.

8. The greeting card device of claim 6 further characterized in that a plurality of magnets are secured to the outer face of said second panel and are enclosed within pockets between said second and third panels.

9. A method of making a greeting card device which is capable of being releaseably supported on a metal containing wall, said method comprising:

a) placing a first substrate having a first surface and a second surface in a relatively horizontal position with said second surface presented upwardly thereon;

b) adhesively securing a magnet to said second surface of said first substrate;

c) placing a second substrate over the second surface of said first substrate in general marginal registration therewith and forming a pocket for enclosing said magnet therebetween and which magnet is spaced inwardly and apart from peripheral edges of said first and second substrates;

d) adhesively securing said second substrate to said first substrate; and e) folding an additional substrate with respect to said first and second substrates to create a greeting card thereof.

10. The method of claim 9 further characterized in that said method comprises applying an adhesive to said second substrate shortly before adhering same to said second surface of said first substrate.

11. The method of claim 9 further characterized in that said second substrate is integral with said first substrate and folded over said first substrate in marginal registration therewith, and thereafter adhesively secured to said first substrate.

12. The method of claim 9 further characterized in that said method comprises pre-printing at least one of said substrates with information on a surface thereof before having the magnet adhesively secured between said substrates.

13. A greeting card device for presenting information thereon and which is capable of being removably secured to a metal containing surface, said greeting card device comprising:

a) a first substrate having a first surface and a second surface and a peripheral edge;

b) a plurality of spaced apart magnets adhered to said second surface of said first substrate and each having a peripheral edge with all portions thereof spaced inwardly from the peripheral edge of the first substrate so that a portion of the first surface surrounds the entire peripheral edge of the magnets;

c) an adhesive layer securing a surface of said magnet to said second surface of said first substrate;

d) a second substrate capable of being disposed over said first substrate and lying in marginal registration therewith thereby enclosing said magnets in individual pockets between said first and second substrates;

e) another adhesive layer securing said second substrate to said first substrate, such that the first and second substrates surround the magnets and form pockets therebetween to snugly hold and encapsulate the respective magnets therein; and f) a third substrate hingedly connected to one of said first or second substrates and capable of being clipped thereon.

14. The greeting card device of claim 13 further characterized in that said greeting card is a postcard and that said first substrate has an outwardly presented surface with information to create a mailable postcard.

15. The greeting card device of claim 13 further characterized in that said card device has indicia on the outer surface of the first substrate and indicia on the outer surface of the third substrate.

16. The greeting card device of claim 13 further characterized in that said second substrate is integral with said first substrate and bent over said first substrate.

* * * * *